US005599051A

United States Patent [19]

Bourgeois

[11] Patent Number: 5,599,051

[45] Date of Patent: Feb. 4, 1997

[54] SECURING DEVICE FOR WINDOW SHUTTERS

[76] Inventor: Joseph L. Bourgeois, 234 E. 22 St., Cut Off, La. 70345

[21] Appl. No.: 420,140

[22] Filed: Apr. 11, 1995

[51] Int. Cl.[6] ..... E05C 17/04

[52] U.S. Cl. ..... 292/262; 49/394; 292/52; 292/341.17; 292/DIG. 19

[58] Field of Search ..... 49/394; 70/32–34; 292/262, 278, 52, 341.17, 341.15, DIG. 19, 32, 35, 63

[56] References Cited

U.S. PATENT DOCUMENTS

| | | | |
|---|---|---|---|
| 308,768 | 12/1884 | Hazen | 292/DIG. 19 X |
| 825,475 | 7/1906 | McGinity | 292/52 X |
| 1,363,599 | 12/1920 | Hull | 70/33 |
| 1,535,625 | 4/1925 | O'Bannon | 292/52 X |
| 2,264,669 | 12/1941 | Kessler | 292/262 |
| 2,409,794 | 10/1946 | Quigley et al. | 292/52 |
| 2,530,365 | 11/1950 | Johnson et al. | 292/DIG. 19 X |
| 2,793,891 | 5/1957 | Frye | 292/341.17 X |
| 3,675,959 | 7/1972 | Hansen et al. | 292/DIG. 19 X |
| 4,361,939 | 12/1982 | Gelula et al. | 292/341.17 X |

FOREIGN PATENT DOCUMENTS

| | | | |
|---|---|---|---|
| 1150006 | 6/1963 | Germany | 292/52 |
| 20178 | 8/1914 | United Kingdom | 292/52 |
| 264342 | 1/1927 | United Kingdom | 292/52 |

*Primary Examiner*—Suzanne L. Dino

[57] ABSTRACT

A securing device for window shutters comprising: a wall base unit formed in a generally planar configuration, the wall base unit including an aperture extending therein, the wall base unit having an outboard surface and an inboard surface, the inboard surface including a coupling device to permit affixation to a recipient surface, the wall base unit including a resilient coupling mechanism contained therein, the resilient coupling mechanism adapted to be easily engaged and disengaged by the user; at least one insert rod formed in an elongated configuration and adapted to be positioned through the aperture in the outboard surface of the wall base unit, each insert rod including coupling devices to permit releasable coupling within the resilient coupling mechanism of the wall base unit, each rod including an attachment device to permit affixation to a window shutter.

1 Claim, 4 Drawing Sheets

SECURING DEVICE FOR WINDOW SHUTTERS

BACKGROUND OF THE INVENTION

1. Field of the Invention

The present invention relates to a securing device for window shutters adjacent walls and more particularly pertains to affixing the components of the apparatus to shutters and adjacent walls to permit releasable coupling of the shutters to the walls.

2. Description of the Prior Art

The use of window shutter mounting devices is known in the prior art. More specifically, window shutter mounting devices heretofore devised and utilized for the purpose of affixing shutters to window frames and other recipient surfaces are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,065,806 to Kondoh a panel shutter assembly.

U.S. Pat. No. 4,606,145 to Trombettas discloses a shutter-type window panel.

U.S. Pat. No. 4,887,391 to Sr. Kenneth W. Briggs discloses a window shutter assembly and method of production.

U.S. Pat. No. 4,846,244 to Rosenfeld discloses a window shutter.

Lastly, U.S. Pat. No. 4,160,343 to Hubbard discloses a window shutter and mounting therefor.

In this respect, the securing device for window shutters according to the present invention substantially departs from the conventional concepts and designs of the prior art, and in doing so provides an apparatus primarily developed for the purpose of affixing the components of the apparatus to shutters and adjacent walls to permit releasable coupling of the shutters to the walls.

Therefore, it can be appreciated that there exists a continuing need for a new and improved securing device for window shutters which can be used for affixing the components of the apparatus to shutters and adjacent walls to permit releasable coupling of the shutters to the walls. In this regard, the present invention substantially fulfills this need.

SUMMARY OF THE INVENTION

In view of the foregoing disadvantages inherent in the known types of window shutter mounting devices now present in the prior art, the present invention provides an improved securing device for window shutters. As such, the general purpose of the present invention, which will be described subsequently in greater detail, is to provide a new and improved securing device for window shutters and method which has all the advantages of the prior art and none of the disadvantages.

To attain this, the present invention essentially comprises a new and improved securing device for window shutters comprising, in combination: a wall base unit having an inboard segment and an outboard segment, the outboard segment formed in a generally cylindrical configuration with an upper surface, a lower surface and a cylindrical side wall therebetween, the outboard segment having a centrally positioned hexagonally shaped aperture extending therethrough, the lower surface of the outboard segment including a cylindrical shaped bore extending therein, the side wall of the outboard segment including two apertures extending therethrough and formed contiguously with the bore, the outboard segment including two bolt holes; the inboard segment of the wall base unit formed in a generally cylindrical shaped configuration with an inner surface, an outer surface and a cylindrical side wall therebetween, the inner surface including two bolt holes extending radially therethrough, the outer surface of the inboard segment including a threaded shaft extending therefrom, the inboard segment having a hexagonally shaped bore extending through it and axially within the threaded shaft, two bolts and nuts coupling the segments together; and two pinch bars formed in a planar generally oval configuration with an inboard region, an outboard region and a central region therebetween, the inboard region of each pinch bar including coupling means and being positioned in the bore of the outboard segment of the wall base unit, the inboard region of each pinch bar including resilient means, the central region of each pinch bar including pivot means rotatably coupled within the outboard segment of the wall base unit, the outboard region of the pinch bars extend through the apertures and within the hexagonally shaped bore of the wall base unit, the apparatus being disengaged with the pinch bars being forced together by the user, the resilient means urging the pinch bars apart and into the engaged orientation upon release by the user; and a plurality of rods formed in a generally cylindrical configuration with an inboard end and an outboard end, at least one rod including a plurality of external screw threads, the inboard end of each rod including a generally cylindrical shaped tip affixed thereto, each tip having six sides and shaped in a hexagonal configuration with a point at its far extent, each point adapted to be positioned through the aperture in the outboard segment and releasably coupled within the coupling means of the inboard region of the pinch bars, at least one rod including a hook at its inboard end, at least one rod including adjustable coupling devices adjacent to its inboard end to permit releasable coupling to shutters of varying thicknesses.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved securing device for window shutters which has all of the advantages of the prior art window shutter mounting devices and none of the disadvantages.

It is another object of the present invention to provide a new and improved securing device for window shutters which may be easily and efficiently manufactured and marketed.

It is further object of the present invention to provide a new and improved securing device for window shutters which is of durable and reliable constructions.

An even further object of the present invention is to provide a new and improved securing device for window shutters which is susceptible of a low cost of manufacture with regard to both materials and labor, and which accordingly is then susceptible of low prices of sale to the consuming public, thereby making such securing device for window shutters adjacent wall economically available to the buying public.

Still yet another object of the present invention is to provide a new and improved securing device for window shutters which provides in the apparatuses and methods of the prior art some of the advantages thereof, while simultaneously overcoming some of the disadvantages normally associated therewith.

Still another object of the present invention is to affix the components of the apparatus to the back faces of shutters and adjacent walls to permit releasable coupling of the shutters to the walls.

Lastly, it is an object of the present invention to provide a new and improved securing device for window shutters comprising: a wall base unit formed in a generally planar configuration, the wall base unit including an aperture extending therein, the wall base unit having an outboard surface and an inboard surface, the inboard surface including a coupling device to permit affixation to a recipient surface, the wall base unit including a resilient coupling mechanism contained therein, the resilient coupling mechanism adapted to be easily engaged and disengaged by the user; at least one insert rod formed in an elongated configuration and adapted to be positioned through the aperture in the outboard surface of the wall base unit, each insert rod including coupling devices to permit releasable coupling within the resilient coupling mechanism of the wall base unit, each rod including an attachment device to permit affixation to a window shutter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
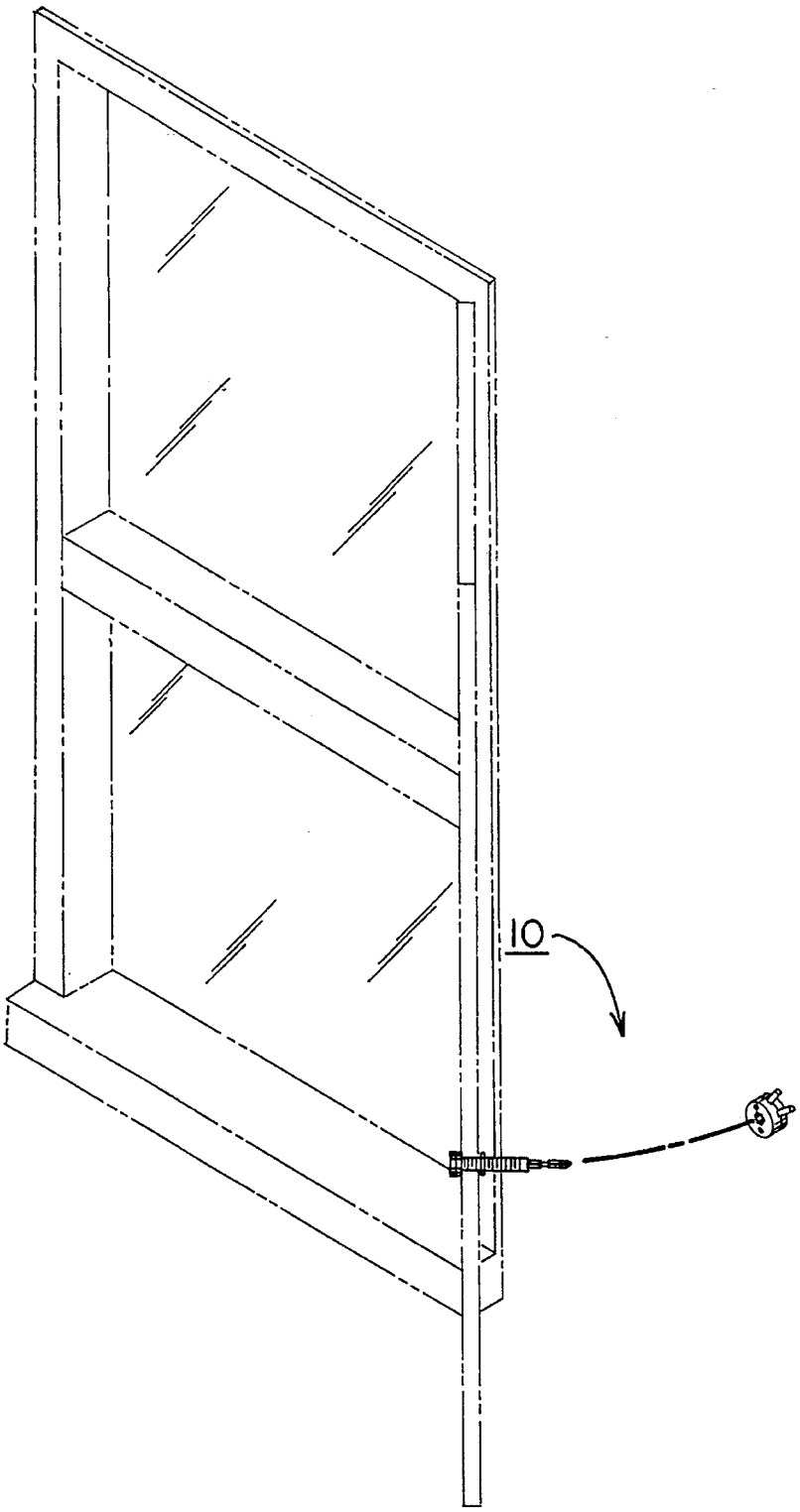
FIG. 1 is a perspective view of the preferred embodiment of the securing device for window shutters constructed in accordance with the principles of the present invention.

With reference now to the drawings, and in particular to FIG. 1 thereof, the preferred embodiment of the new and improved securing device for window shutters embodying the principles and concepts of the present invention and generally designated by the reference numeral 10 will be described.

The present invention, the securing device for window shutters 10 is comprised of a plurality of components. Such components in their broadest context include a wall base unit 12, two pinch bars 14 and a plurality of insert rods 16. Such components are individually configured and correlated with respect to each other so as to attain the desired objective.

Figure 2:
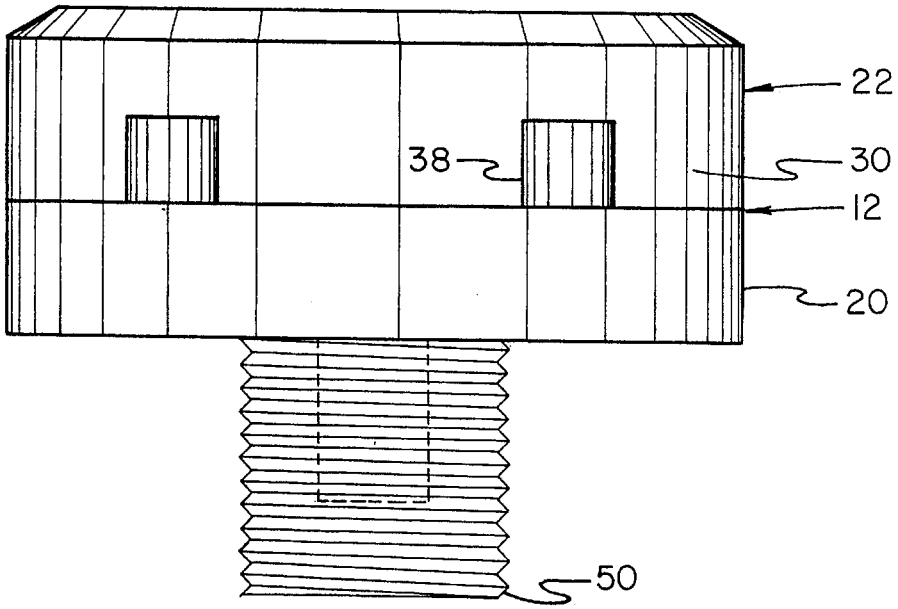
FIG. 2 is a side perspective view of the wall base unit illustrating the positioning of the pinch bars of the apparatus.
Figure 3:
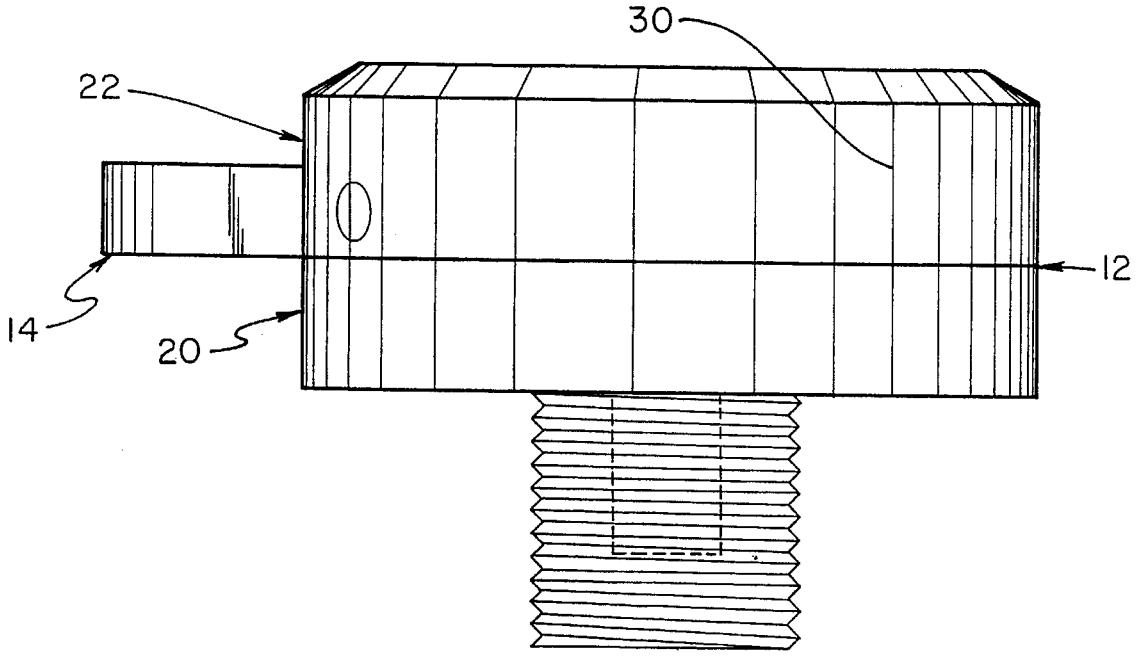
FIG. 3 is a side perspective view of the wall base unit illustrating the length of the outboard region of a pinch bar.

More specifically, the wall base unit 12 is formed in a generally cylindrical configuration and has an inboard segment 20 and an outboard segment 22. The outboard segment is formed in a generally cylindrical configuration with an upper surface 26, a lower surface 28 and a cylindrical side wall 30 therebetween. The outboard segment has a centrally positioned hexagonally shaped aperture 32 extending axially through it. The aperture is appropriately sized and spaced to receive an insert rod in the operative orientation. Note FIGS. 1–3.

Figure 7:
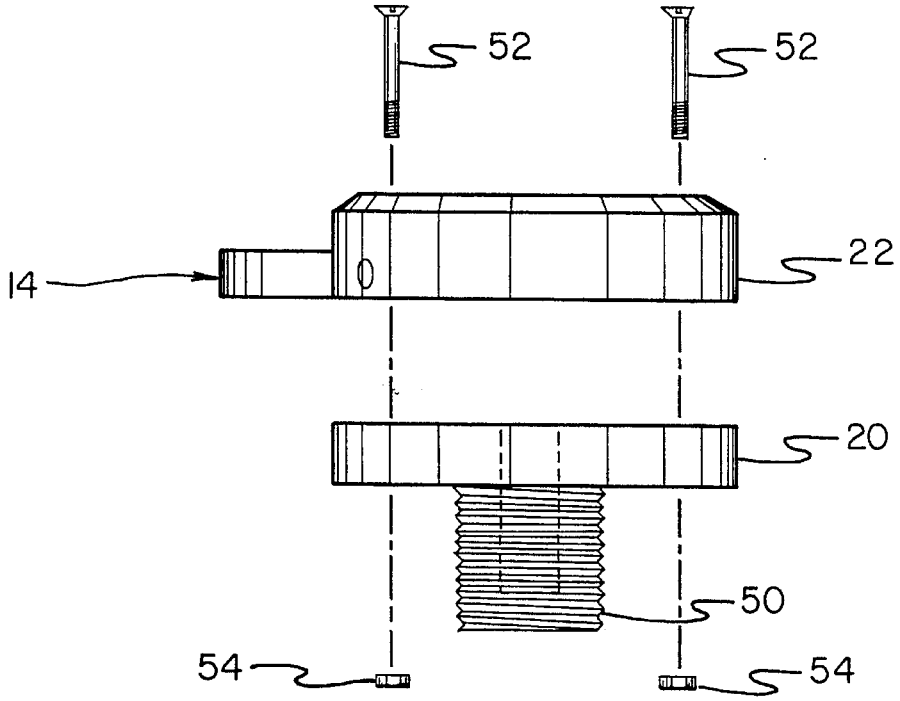
FIG. 7 is a separated, side perspective illustration of the wall base unit illustrating the positioning of the nuts and bolts which couple the inboard and outboard segments together.

The lower surface of the outboard segment includes a cylindrical shaped bore 36 extending within it. The bore extends within a majority of the interior of the outboard segment. The side wall 30 of the outboard segment includes two apertures 38 which extend through it and are formed contiguously with the cylindrical shaped bore 36. The outboard segment includes two bolt holes 40. The bolt holes are adapted to permit easy coupling of the inboard segment to the outboard segment with cooperatively coupled nuts and bolts. Note FIGS. 2 and 7.

The inboard segment 20 of the wall base unit is formed in a generally cylindrical shaped configuration and has an inner surface, an outer surface and a cylindrical side wall therebetween. The inner surface has two bolt holes 44 extending through it. When assembling the apparatus, the bolt holes of the two segments of the wall base unit are positioned in alignment. The outer surface of the inboard segment includes a threaded shaft 50 extending from it. The inboard segment has a hexagonally shaped bore 46 extending axially through it and within the threaded shaft 50. The shaft is adapted to be easily screwed into a wall or some other recipient surface. The length of the bore in the shaft provides the apparatus with additional clearance in which to retain insert rods of varying lengths. The closed end of the bore prevents moisture and insects from entering the wall cavity. Two bolts 52 and nuts 54 couple the segments together through their aligned bolt holes. Note FIGS. 2 and 3.

Figure 4:
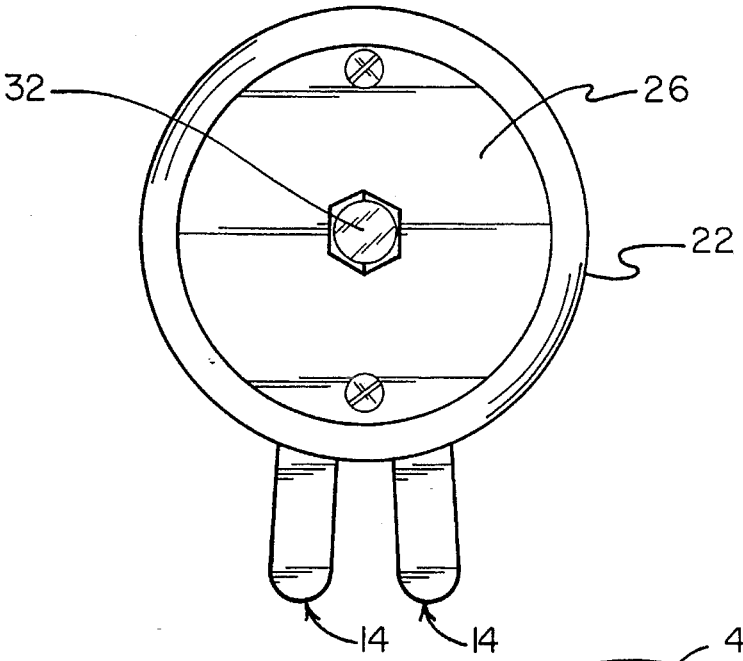
FIG. 4 is a top plan view of the apparatus illustrating the outboard segment of the wall base unit.
Figure 5:
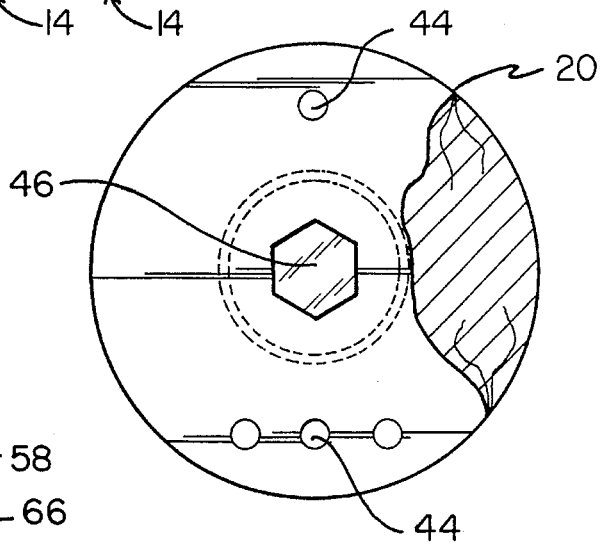
FIG. 5 is a perspective view of the inner surface of the inboard segment of the wall base unit.
Figure 6:
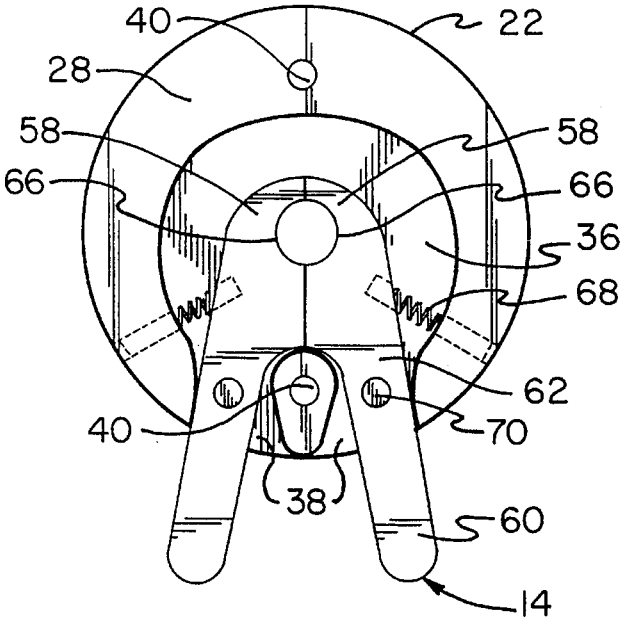
FIG. 6 is a perspective illustration of the outboard segment of the wall base unit illustrating the positioning of the pinch bars through the bore of the outboard segment.

Two pinch bars 14 are formed in a planar generally oval configuration with an inboard region 58, an outboard region 60 and a central region 62 therebetween. The inboard region of each pinch bar includes coupling means 66 and is positioned in the bore 36 of the outboard segment of the wall base unit. The coupling means are in the form of semicircular shaped grooves. When an insert rod is inserted within the apparatus the pinch bars are released by the user and the semicircular shaped grooves clamp around the insert rod adjacent to the point of the rod. This locks the insert rod within the groove. Note FIGS. 4 and 6.

The inboard region of each pinch bar includes resilient means 68. The resilient means are affixed within the bore adjacent to each pinch bar. The resilient means urge the inboard region of the pinch bars into the closed lock position upon release by the user. The central region of each pinch bar includes pivot means 70 rotatably coupled within the outboard segment of the wall base unit. The pivot means are affixed to each pinch bar in a perpendicular orientation. The apparatus is disengaged when the outboard regions of the pinch bars are forced together by the user. The resilient means 68 urge the inboard region of the pinch bars together and into the engaged orientation upon release by the user. Note FIGS. 6 and 7.

Figure 8:
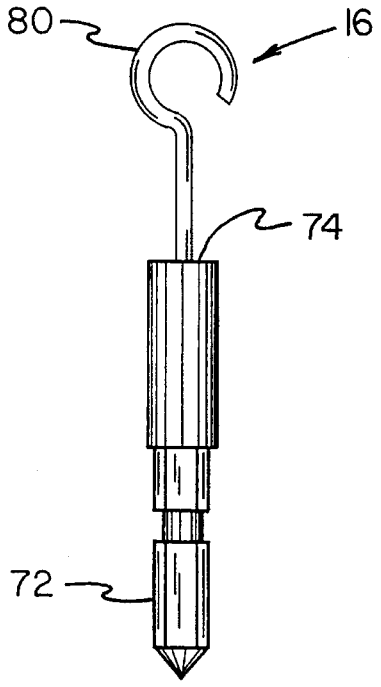
FIGS. 8–10 are perspective illustrations of the insert rods of the apparatus.
Figure 9:
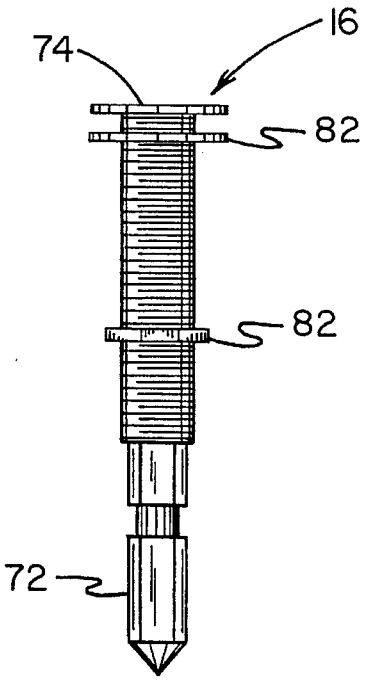
Figure 10:
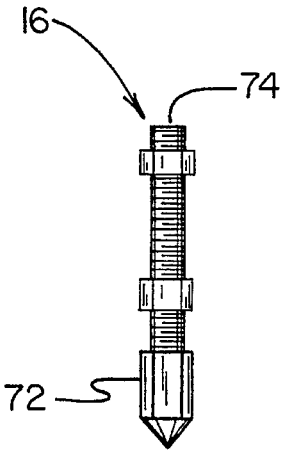

A plurality of insert rods 16 are formed in a generally cylindrical configuration with an inboard end 72 and an outboard end 74. At least one rod includes a plurality of external screw threads. Note FIG. 10. The external screw threads permit the coupling of nuts thereto. In the operative orientation a shutter is positioned between the nuts in a tight locked position thereby firmly coupling the rod to the shutter. The inboard end of each rod includes a generally cylindrical shaped tip 72 affixed thereto. Each tip has six sides and is shaped in a hexagonal configuration with a point 76 at its far extent. Each point is adapted to be positioned through the aperture in the outboard segment and releasably coupled within the coupling means of the pinch bars. Note FIGS. 8–10.

The diameter of each rod is slightly smaller adjacent to the tip. This small diameter permits the locking of the insert rods within the coupling means of the inboard region of each pinch bar. At least one rod includes a hook 80 at its inboard end. In alternative embodiments of the apparatus the wall base unit may be positioned in ceilings and other surfaces. The hook component of at least one of the rods enables the user to easily couple and decouple plants and other hanging items from a wall base unit positioned in the ceiling of a structure. At least one rod includes adjustable coupling devices 82 adjacent to its inboard end to permit releasable coupling to shutters of varying thicknesses. Note FIGS. 6 and 8–10.

The securing device for window shutters is a device which securely affixes window shutters to walls when the shutters are opened. The apparatus consists of an insert which is screwed into the back face of the open shutter. An insert rod drops into the wall base unit which is coupled to a wall or some other recipient surface. Pinch bars with resilient means couple with the insert rods to prevent them from becoming dislodged. Hexagonally shaped points on the rods are precisely shaped to fit within the aperture of the wall base unit. The wall base unit is coupled to a recipient surface such as a wall. The apparatus is suitably protected to withstand corrosion from the elements and chemicals in the atmosphere. To close the shutter, the pinch bars are squeezed together permitting release of the insert. An appropriately sized insert rod is coupled to each shutter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved securing device for window shutters comprising, in combination:

a wall base unit having an inboard segment and an outboard segment, the outboard segment formed in a generally cylindrical configuration with an upper surface, a lower surface and a cylindrical side wall therebetween, the outboard segment having a centrally positioned hexagonally shaped aperture extending therethrough, the lower surface of the outboard segment including a cylindrical shaped bore extending therein, the side wall of the outboard segment including two apertures extending therethrough and formed contiguously with the bore, the outboard segment including two bolt holes;

the inboard segment of the wall base unit formed in a generally cylindrical shaped configuration with an inner surface, an outer surface and a cylindrical side wall therebetween, the inner surface including two bolt holes extending radially therethrough, the outer surface of the inboard segment including a threaded shaft extending therefrom, the inboard segment having a hexagonally shaped bore extending therethrough and axially within the threaded shaft, two bolts and nuts coupling the segments together; and two pinch bars formed in a planar generally oval configuration with an inboard region, an outboard region and a central region therebetween, the inboard region of each pinch bar including coupling means and being positioned in the bore of the outboard segment of the wall base unit, the inboard region of each pinch bar including resilient means, the central region of each pinch bar including pivot means rotatably coupled within the outboard segment of the wall base unit, the outboard region of the pinch bars extend through the two sidewall apertures of the outboard segment and within the hexagonally shaped bore of the wall base unit, the apparatus being disengaged with the pinch bars being forced together by a user, the resilient means urging the pinch bars apart and into an engaged orientation upon release by the user; and a plurality of insert rods formed in a generally cylindrical configuration with an inboard end and an outboard end, at least one rod including a plurality of external screw threads, the inboard end of each rod including a generally cylindrical shaped tip affixed thereto, each tip having six sides and shaped in a hexagonal configuration with a point, each point adapted to be positioned through an aperture in the outboard segment and releasably coupled within the coupling means of the inboard region of the pinch bars, at least one rod including a hook at the outboard end, at least one rod including adjustable coupling devices adjacent to the inboard end to permit releasable coupling to shutters of varying thicknesses, the diameter of each rod being smaller adjacent to the tip, the smaller diameter permitting locking of the insert rods within the coupling means of each pinch bar.

* * * * *